US008154415B2

(12) United States Patent
Penney et al.

(10) Patent No.: US 8,154,415 B2
(45) Date of Patent: Apr. 10, 2012

(54) DETECTOR

(75) Inventors: Stephen John Penney, Middlesex (GB); Don Brighenti, Westminster, MA (US)

(73) Assignee: SimplexGrinnell LP, Westminster, MA (US)

( * ) Notice: Subject to any disclaimer, the term of this patent is extended or adjusted under 35 U.S.C. 154(b) by 441 days.

(21) Appl. No.: 12/530,241

(22) PCT Filed: Mar. 11, 2008

(86) PCT No.: PCT/GB2008/000838

§ 371 (c)(1),
(2), (4) Date: Sep. 8, 2009

(87) PCT Pub. No.: WO2008/110785

PCT Pub. Date: Sep. 18, 2008

(65) Prior Publication Data

US 2010/0085200 A1 Apr. 8, 2010

(30) Foreign Application Priority Data

Mar. 13, 2007 (GB) ..... 0704847.3

(51) Int. Cl.
*G08B 17/10* (2006.01)

(52) U.S. Cl. ..... 340/630; 340/627; 340/628; 340/632

(58) Field of Classification Search ..... 340/630
See application file for complete search history.

(56) References Cited

U.S. PATENT DOCUMENTS

| | | | | |
|---|---|---|---|---|
| 6,114,967 | A | 9/2000 | Yousif | |
| 2002/0044061 | A1 * | 4/2002 | Johnston et al. | 340/628 |
| 2006/0176169 | A1 * | 8/2006 | Doolin et al. | 340/521 |

FOREIGN PATENT DOCUMENTS

| | | | |
|---|---|---|---|
| CH | 633 122 | A5 | 11/1982 |
| EP | 1 045 354 | A2 | 10/2000 |
| EP | 1 045 354 | A3 | 10/2000 |
| EP | 1 413 997 | A2 | 4/2004 |
| EP | 1 413 997 | A3 | 4/2004 |
| EP | 1 524 404 | A2 | 4/2005 |
| EP | 1 524 404 | A3 | 4/2005 |
| GB | 2 405 514 | A | 3/2005 |
| WO | WO 01/43098 | A2 | 6/2001 |
| WO | WO 01/43098 | A3 | 6/2001 |
| WO | WO 2007/051517 | A1 | 5/2007 |

* cited by examiner

*Primary Examiner* — George Bugg
*Assistant Examiner* — Kerri McNally

(57) ABSTRACT

A detector comprises a detector base (1) and first and second detector elements (2 & 3) each having a respective electronic interface (2*a*, 3*a*). The detector base (1) has electronic interfaces (1*a*) to the electronic interface (2*a*, 3*a*) of each of the detector elements (2, 3), wherein at least one of the detector elements is constructed as a replaceable module (11).

14 Claims, 2 Drawing Sheets

DETECTOR

RELATED APPLICATION

This application claims the benefit of the prior foreign application GB 0704847.3, filed Mar. 13, 2007. The entire teachings of the above application are incorporated herein by reference.

BACKGROUND OF THE INVENTION

This invention relates to a detector, and in particular to a fire detector.

A fire detector typically includes a sensing element such as an optical smoke sensing element, a CO sensor for detecting carbon monoxide, or a pyroelectric sensor for detecting the presence of a flame. Fire detectors based on the sensing of a single fire product (smoke, CO or flame) have, in recent years, been superseded by detectors based on the sensing of two or more combustion products. One of the combinations that is gaining popularity is the use of a CO sensor to support the customary optical detection of visible smoke, giving potential advantages in increasing discrimination between fire and false alarm sources.

Unfortunately, a fire detector having two or more sensing elements has inherent problems, as the different sensing elements tend to decay with time differently, and age differently. Moreover, in order to incorporate two or more sensing elements, existing detector designs have to increase in complexity considerably, thereby leading to a reduction in reliability.

Another problem that exists is that each sensing element has to be calibrated independently during production, with the calibration results being stored by means such as a trim pot, a select on test (SOT) resistor, an EEPROM or a mechanical link. This becomes more awkward and complex when a detector includes two or more sensing elements.

The main problem with such a detector is, however, the cost of replacement, as the sensing elements are provided on a single detector base. Hence, if the detector includes an optical smoke sensor and a CO sensor, the entire detector has to be replaced when one of the sensing elements (usually the CO sensor which tends to decay much quicker than the optical smoke sensor) decays to such an extent that it can no longer reliably sense a fire.

SUMMARY OF THE INVENTION

An aim of the invention is to provide a detector having two or more sensing elements, at least one of which can be replaced independently of other parts of the detector.

The present invention provides a detector comprising first and second detector elements each having a respective electronic interface, and a detector base having an electronic interface to the electronic interface of each of the detector elements, the detector base further having communication electronics, wherein at least one of the detector elements is constructed as a replaceable module, and wherein the communication electronics is configured to communicate information received from each detector element via the electronics interface of the detector base to a central control unit; characterised in that the first detector element includes a first sensor for sensing a first physical property, and the second detector element includes a second sensor for sensing a second physical property which is different from the first physical property, in that the detector base is enhanced by the provision of means for analysing signals output by each of the detector elements, thereby to provide an increased fire detection capability; and in that the electronic interface of each detector element is just sufficient to enable effective communication with the detector base, each electronic interface comprising a current-to-voltage converter, a buffer amplifier and a self-monitoring circuit.

In a preferred embodiment, each electronic interface comprises a current-to-voltage converter, a buffer amplifier and a self-monitoring circuit.

Preferably, the or each replaceable module is shaped and sized to complement an aperture formed in the detector base. Conveniently, the or each replaceable module is provided with means for detachable connection to the detector base. The or each detachable means may be clip-on means. Preferably, the or each replaceable module is provided with a partially-cut-out tab which is engageable with an apertured recess formed in the detector base, the tab and recess constituting said detachable connection means.

Advantageously, the or each replaceable module is provided with an upstanding apertured flange which is engageable with a projection provided at the peripheral front edge of the aperture formed in the detector base.

Alternatively, the or each replaceable module is provided with a projection or recess for slidable engagement with a complementary recess or projection provided on the detector base.

In a preferred embodiment, the first sensor is such as to sense CO, and the second sensor is such as to sense smoke, the detector constituting a fire detector.

In another preferred embodiment, the first detector element is constituted by a replaceable module, and the second detector element is formed integrally with the detector base.

Advantageously, the electronic interface the or each replaceable module is adapted for communicating a signal indicative of the physical entity sensed by its sensor to the electronic interface of the detector base.

Preferably, the detector further comprises a flasher, a strobe unit or an IR detector.

The invention also provides a system comprising a detector and a central control unit, the detector being as defined above, and the central control unit being configured to treat the information received from the detector as either complementary signals or independent signals.

Preferably, when both fire and toxin are sensed, the system is such as to generate an evacuation procedure that is different than that generated when fire is detected with no detection of a toxin.

BRIEF DESCRIPTION OF THE DRAWING

The invention will now be described in greater detail, by way of example, with reference to the drawing, in which:—

DESCRIPTION

Figure 1:
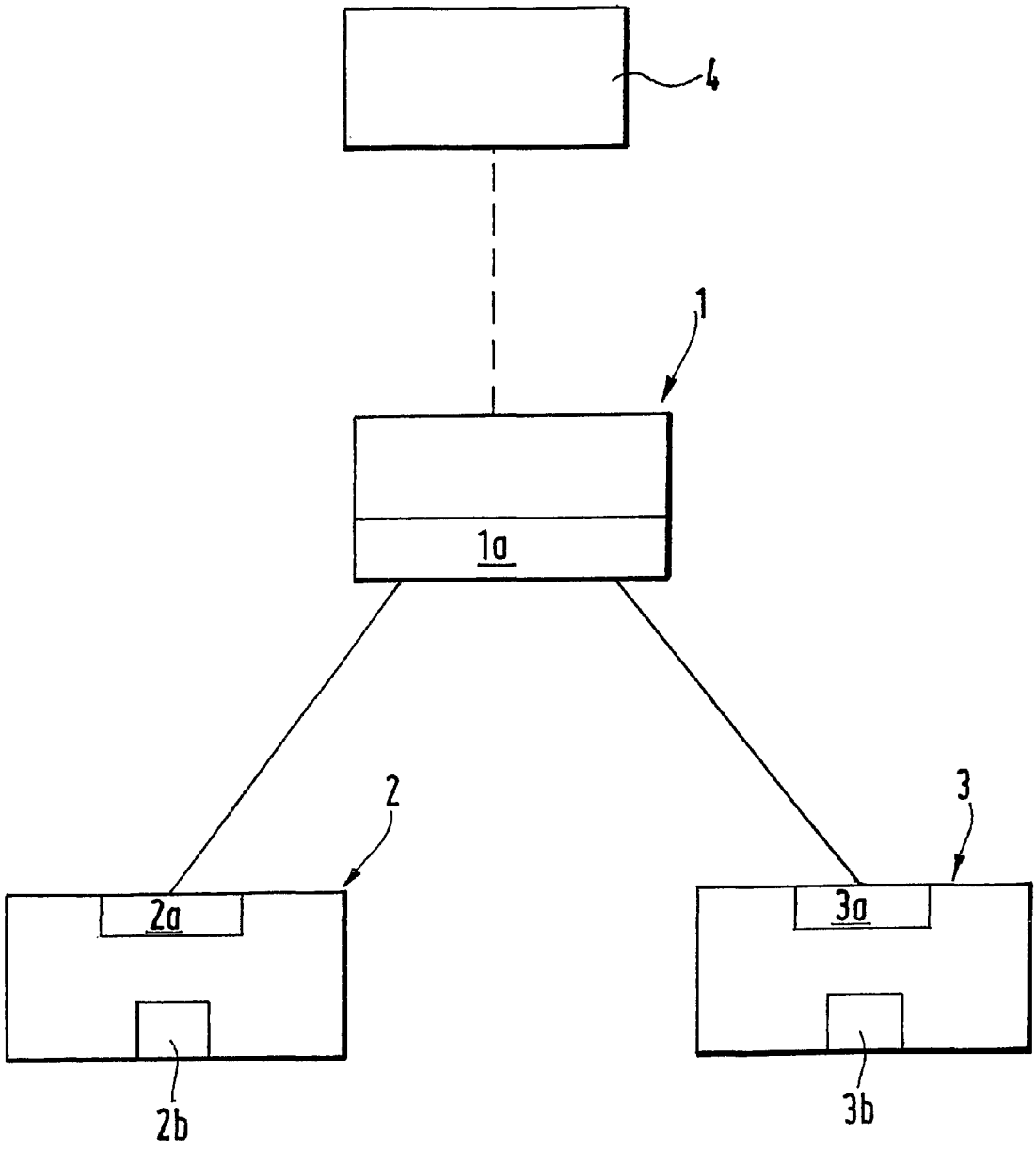
FIG. 1 is a schematic representation of a detector constructed in accordance with the invention.

Referring to the drawing, a fire detector is constituted by a detector base 1 and first and second detector elements 2 and 3. The detector base 1 is attached to a software-controlled control and indicating equipment (CIE) 4, either by on-site wiring or wirelessly. The CIE 4 is provided to monitor and control the fire detector and other fire detectors associated with a particular location such as a large building.

The detector base 1 is provided with an electronic interface la to the CIE 4 and to the two detector elements 2 and 3. The detector base 1 is also provided with communications electronics (not shown). The interface of the detector base 1 provides a separate contact arrangement to link the detector base respectively with the two detector elements 2 and 3. Each of the detector elements 2 and 3 is provided with respective front-end electronics 2*a*, 3*a* for communication with the electronic interface 1*a* provided in the detector base 1. The front-end electronics 2*a*, 3*a* of the detector elements 2 and 3 are each provided with respective contact arrangements (not shown) for physical engagement with the contact arrangements (not shown) provided in the detector base 1. Alternatively, the front-end electronics 2*a*, 3*a* of each of the detector elements 2 and 3 may be connected to the electronic interface la of the detector base wirelessly.

The first detector element 2 is provided with an optical smoke detecting sensor 2*b*, and the second detector element 3 is provided with a CO sensor 3*b*. The front-end electronics 2*a*, 2*b* of each of the detector elements 2 and 3 is constituted by integral interface electronics and associated circuitry which is used for calibration purposes. The front-end electronics 2*a*, 2*b* is, in each case, just sufficient to enable effective communication with the detector base 1, and typically comprises a front-end, current-to-voltage converter, a buffer amplifier and a self-monitoring circuit. The self-monitoring circuit can be of the type described in our International patent application number PCT/GB2005/001641.

As each of the detector elements 2 and 3 is an item separate from the detector base 1, failure of one of these detector elements necessitates replacement of only that detector element and its limited electronics, so that the replacement costs for this type of detector are substantially reduced when compared with known detectors having two or more sensors.

Each of the detector elements 2 and 3 can be provided as a module that can be clipped onto the detector base 1, thereby providing a detector configuration which is similar to known detectors. Alternatively, the detector element 2 could be incorporated into the detector base 1, in which case only the detector element 3 is provided as a clip-on module. In this case, the detector base/smoke detecting module would be substantially identical to a standard fire detector which has a detector base with a smoke detector built in, and the detector base behaves as a normal smoke detector base. However, the detector base 1 includes additional components which are connected to the CO sensor 3*b* of the detector element 3, and which can also analyze the signals associated with both the standard smoke detector element 2, as well as the additional information from the CO sensor. In this way, the detector described above can distinguish a fire more accurately than can the standard detector provided only with a smoke detecting sensor.

Figure 2:
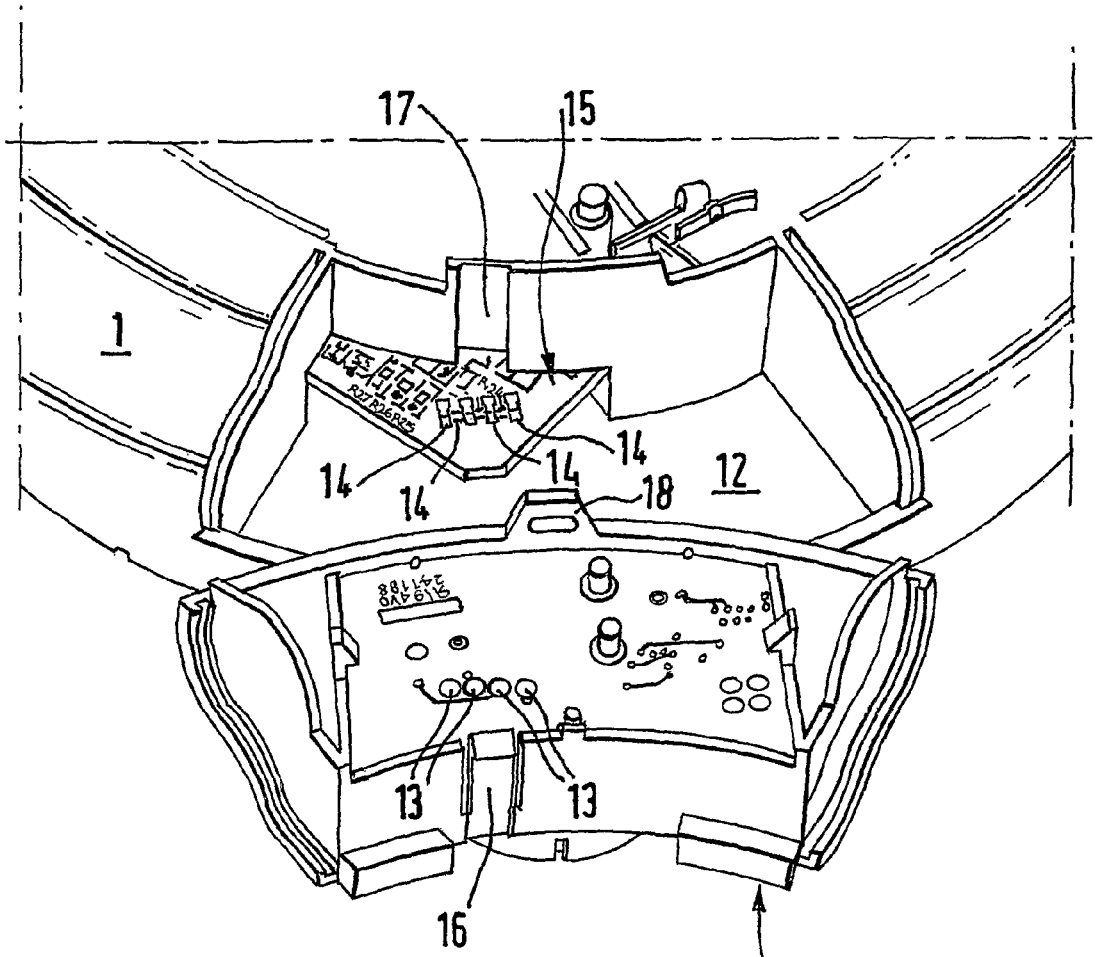
FIG. 2 is a perspective view of part of a detector showing how a detector module is detachably mounted thereto.

FIG. 2 shows a modified form of fire detector in which the detector element 2 (not shown) is incorporated in the detector base 1. The detector element 3 is incorporated in a module 11 which is shaped and sized to complement an aperture 12 formed in the detector base 1. The module 11 is shown, in FIG. 2, in a position separated from the detector base 1, and upside-down, so as to show more clearly its characteristic features. The module 11 is provided with electrical contacts 13 for engagement with corresponding contacts 14 provided on electronic interface 15 (part of which is visible in FIG. 2). The module 11 is provided with a partially-cut-out tab 16 which, in use, is engageable with an apertured recess 17 formed in the detector base 1. The module 11 is also provided with an upstanding apertured flange 18 which is engageable with a projection (not shown) provided at the peripheral front edge of the aperture 12 formed in the detector base 1. The engagement of the tab 16 and the aperture recess 17, together with the engagement of the apertured flange 18 and the corresponding projection enable the module 11 to be clipped onto the detector base.

It will be apparent that the detector described above has a number of advantages compared with known fire detectors. In particular, the detector element 3 can be replaced independently of the rest of the detector. This is particularly important as the lifetime of its CO sensor 3*b* is considerably less than the lifetime of the smoke detecting sensor 2*b*. As a result, replacement costs for this fire detector are considerably reduced when compared with known fire detectors. Moreover, the front-end electronics 2*a*, 2*b* of each replaceable module is minimized, thereby further reducing the replacement costs. Moreover, apart from hardware replacement costs, time costs for replacement are also reduced as replacement of a clip-on module takes considerably less time than replacement of an entire detector. This replacement process is also more environmentally friendly, as usually only one, relatively-small part (the replaceable clip-on module) needs to be disposed of.

Another advantage of the fire detectors described above is that, when the detector base 1 is controlled by a remote panel such as the CIE, this can be done in such a way that the CIE characterises the detector within its software, and so can use a multiplicity of controlled fire detectors in conjunction with processing algorithms to meet best the fire/gas detection needs of given site. This is because the signals received by the CIF, can be treated either as complementary signals or as independent signals.

It will be apparent that the invention described above could be modified in a number of ways. For example, the invention could be extended to cover any multiplicity of separate detector elements within a single detector base, where those elements are independently replaceable, but use a common signalling system within the detector base. The outputs of the sensors associated with the detector elements can, therefore, be processed by software that takes into account each of the parameters measured to represent a near identical time and position sample of the environment at that point. Thus, the detection capabilities of such a detector are considerably enhanced.

It will also be apparent that the detector described above could be modified to cover many other forms of detection. For example, it could be adapted to cover the detection of a terrorist attack where a fire bomb contains a particular toxin. A detector provided with a toxin detector could be incorporated in a fire detector having an optical smoke detector element and a CO detector element. This would enable a detection system to distinguish between an ordinary fire, or a fire associated with a particular toxin. This would then enable the evacuation procedure for the associated site to be controlled differently for each type of fire. Thus, where both fire and toxin are sensed, the evacuation procedure would be very different to that used where a fire occurs with no toxin.

In a further modification, the detector of the invention could be used with devices such as a flasher, a strobe unit, or an infrared detector.

In yet another modification, where a detector element 2 or 3 is provided on an easily-removable module, this can be accomplished in any suitable way. For example, each such module could be provided with a projection or a recess for slidable engagement with a complementary recess or projection provided on the detector base. It would also be possible to connect such a module to the detector base by means of screws.

The invention claimed is:

1. A detector comprising:

first and second detector elements each having a respective electronic interface; and a detector base having an electronic interface to the electronic interface of each of the detector elements, the detector base further having communication electronics, wherein at least one of the detector elements is constructed as a replaceable module, and wherein the communication electronics is configured to communicate information received from each detector element via the electronics interface of the detector base to a central control unit;

wherein the first detector element includes a first sensor for sensing a first physical property, and the second detector element includes a second sensor for sensing a second physical property which is different from the first physical property;

wherein the detector base analyzes signals output by each of the detector elements, thereby providing an increased fire detection capability; and wherein the electronic interface of each detector element enables effective communication with the detector base, each electronic interface comprising a current-to-voltage converter, a buffer amplifier and a self-monitoring circuit.

2. A detector as claimed in claim 1, wherein the at least one replaceable module is shaped and sized to complement an aperture formed in the detector base.

3. A detector as claimed in claim 2, wherein the at least one replaceable module further comprises means for detachable connection to the detector base.

4. A detector as claimed in claim 3, wherein the at least one replaceable module is provided with a partially-cut-out tab which is engageable with an apertured recess formed in the detector base, the tab and recess constituting said detachable connection means.

5. A detector as claimed in claim 2, wherein the at least one replaceable module is provided with an upstanding apertured flange which is engageable with a projection provided at the peripheral front edge of the aperture formed in the detector base.

6. A detector as claimed in claim 1, wherein the at least one replaceable module is provided with a projection or recess for slidable engagement with a complementary recess or projection provided on the detector base.

7. A detector as claimed in claim 1, wherein the at least one replaceable module uses a common signalling system within the detector base.

8. A detector as claimed in claim 1, wherein the first sensor senses CO, and the second sensor senses smoke, the detector constituting a fire detector.

9. A detector as claimed in claim 1, wherein at least one of the detector elements is a toxin detector element.

10. A detector as claimed in claim 9, wherein when both fire and toxin are sensed, a system is such as to generate an evacuation procedure that is different than that generated when fire is detected with no detection of a toxin.

11. A detector as claimed in claim 1, wherein the first detector element is a replaceable module, and the second detector element is formed integrally with the detector base.

12. A detector as claimed claim 1, wherein the electronic interface of the at least one replaceable module is adapted for communicating a signal indicative of a physical entity sensed by its sensor to the electronic interface of the detector base.

13. A detector as claimed in claim 1, further comprising a flasher, a strobe unit or an IR detector.

14. A system comprising a detector as claimed in claim 1 and the central control unit, the central control unit being configured to treat information received from the detector as either complementary signals or independent signals.

* * * * *

UNITED STATES PATENT AND TRADEMARK OFFICE

CERTIFICATE OF CORRECTION

PATENT NO. : 8,154,415 B2
APPLICATION NO. : 12/530241
DATED : April 10, 2012
INVENTOR(S) : Stephen John Penney and Don Brighenti It is certified that error appears in the above-identified patent and that said Letters Patent is hereby corrected as shown below:

On the Title Page, Item (73) ASSIGNEE:

Whereas, "SimplexGrinnell LP, Westminster, MA (US)" should be corrected to read

"Thorn Security Limited, Sunbury-on-Thames, Middlesex (GB); SimplexGrinnell LP, Westminster, MA (US)"

Signed and Sealed this
Sixteenth Day of October, 2012

David J. Kappos

David J. Kappos
*Director of the United States Patent and Trademark Office*